United States Patent [19]

Sorenson et al.

[11] Patent Number: 4,571,467

[45] Date of Patent: Feb. 18, 1986

[54] THREE POSITION CENTER-OFF ELECTRICAL SWITCH

[75] Inventors: Richard W. Sorenson, Avon; Milton N. Ives, Wolcott, both of Conn.

[73] Assignee: Carlingswitch, Inc., West Hartford, Conn.

[21] Appl. No.: 517,422

[22] Filed: Jul. 26, 1983

[51] Int. Cl.[4] ..... H01H 21/00

[52] U.S. Cl. ..... 200/6 BA; 200/68.2

[58] Field of Search ..... 200/68.2, 68.1, 68.3, 200/67 A, 6 B, 6 BA, 6 BB, 6 R

[56] References Cited

U.S. PATENT DOCUMENTS 2,797,275 6/1957 Seeger ..... 200/68.2 X 2,975,250 3/1961 Long et al. ..... 200/68.2 X 3,586,796 6/1971 Simovits, Jr. et al. ..... 200/6 BA 3,671,693 6/1972 Farrell ..... 200/68.2 X 4,121,071 10/1978 Campbell et al. ..... 200/67 A X

*Primary Examiner*—J. R. Scott

*Attorney, Agent, or Firm*—McCormick, Paulding & Huber

[57] ABSTRACT

A three position switch has three blade or strip type fixed contacts, which can be assembled by insertion in slots provided in the switch case. The switch has a stable center-off condition without requiring a yoke on the center fixed contact. The movable contact cooperates with the actuator's plunger portion to define this center-off switch condition and the elimination of such a yoke provides a simpler switch.

6 Claims, 8 Drawing Figures

THREE POSITION CENTER-OFF ELECTRICAL SWITCH

SUMMARY OF THE INVENTION

This invention relates generally to electrical switches of the type having a generally rectangular base portion of insulated plastic material, and having several fixed electrical contacts provided in a lower wall of the case so that a movable contact element is adapted to bridge certain of these fixed contacts in response to movement of an actuator provided in the upper portion of the base. The present invention deals more particularly with a unique configuration for the coupling provided between the actuator and the movable contact element. A center fixed contact is of the simple strip type, which strip is adapted to support the movable contact in a switch "off" position where the depending portion of the actuator is oriented in alignment with the fixed center contact, and it is a feature of the present invention that the center contact need not have any yoke configuration to inhibit pivotable movement of the movable contact element, the latter being pivotably mounted at the upper end of the strip shaped fixed contact and prevented from translation laterally in response to such movement of the actuator by means defined in the switch case side walls.

The general purpose of the present invention is to provide a switch construction wherein the base has an actuator supported therein for movement relative to the case and more particularly so that a depending portion of the actuator is adapted to move longitudinally in the generally rectangular switch cavity. A plunger is carried by the actuator and moves in response to actuator movement so that a movable contact element coupled to the plunger can be pivoted about a center fixed contact in order to selectively bridge oppositely disposed end contacts depending upon switch position. In a center, or off position of the movable contact element and actuator, only the center contact is touching the movable element. Means is provided for restricting the movable contact element from longitudinal sliding movement relative to the fixed contacts and the plunger has a lower end portion which is so shaped as to cooperate with an intermediate portion of the movable contact element in order to inhibit pivotable movement of the movable contact on top of the center fixed contact in the switch off condition.

Heretofore, a pivotable contact element in such a switch case generally is mounted in a yoke defined for this purpose at the inner end portion of the center fixed contact, which yoke contacts space portions of the underside of the movable contact element to define the intermediate center-off switch condition. The plunger portion of the actuator is generally spring biased downwardly and contacts a center portion of the movable contact for achieving pivotal movement thereof and the center-off position in a conventional switch results when the lower end of the plunger contacts the center of the movable contact element between the two spaced positions defined by the yoke shaped center contact itself.

The general purpose of the present invention is to obviate the need for a yoke defining element at the inner end of the center-fixed contact in such a switch.

DETAILED DESCRIPTION

Turning now to the drawings in greater detail, FIGS. 1–4 inclusively a present preferred embodiment of the present invention wherein the electrical switch provides a very economical center-off switch capable of alternate on positions as well as a stable center-off position, and wherein the fixed center contact does not include an internal yoke shaped support for pivotally receiving the movable contact element itself.

A one piece molded plastic base 10 has an upwardly open cavity **10*a*, which cavity is defined in part by a bottom wall 10*b* in which a plurality of fixed contacts 12, 14 and 16 are provided in slots of the bottom wall 10*b***.

Figure 1:
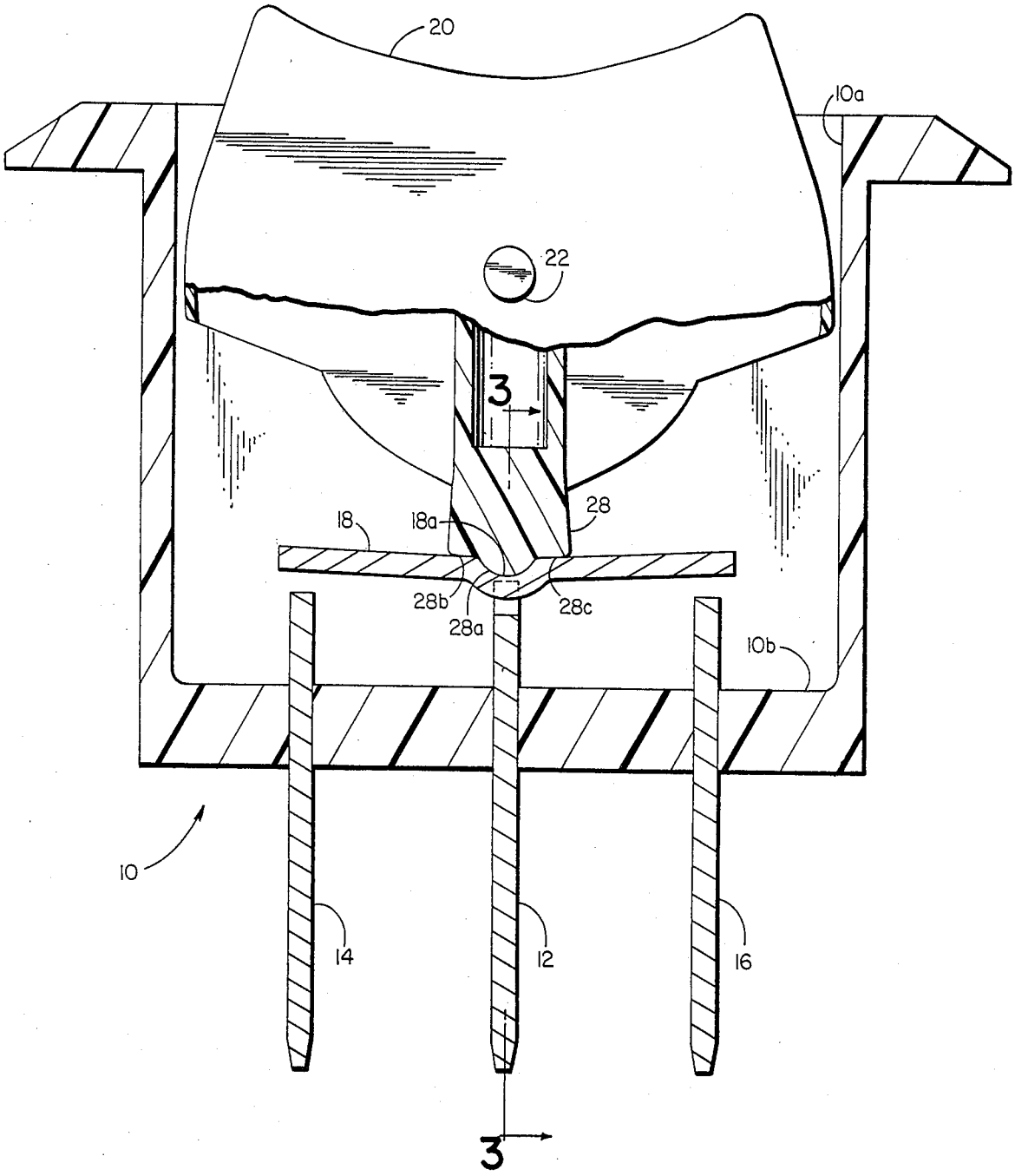
FIG. 1 is a vertical sectional view through a switch constructed in accordance with the present invention and illustrates the actuator and movable contact element in the center-off position.
Figure 2:
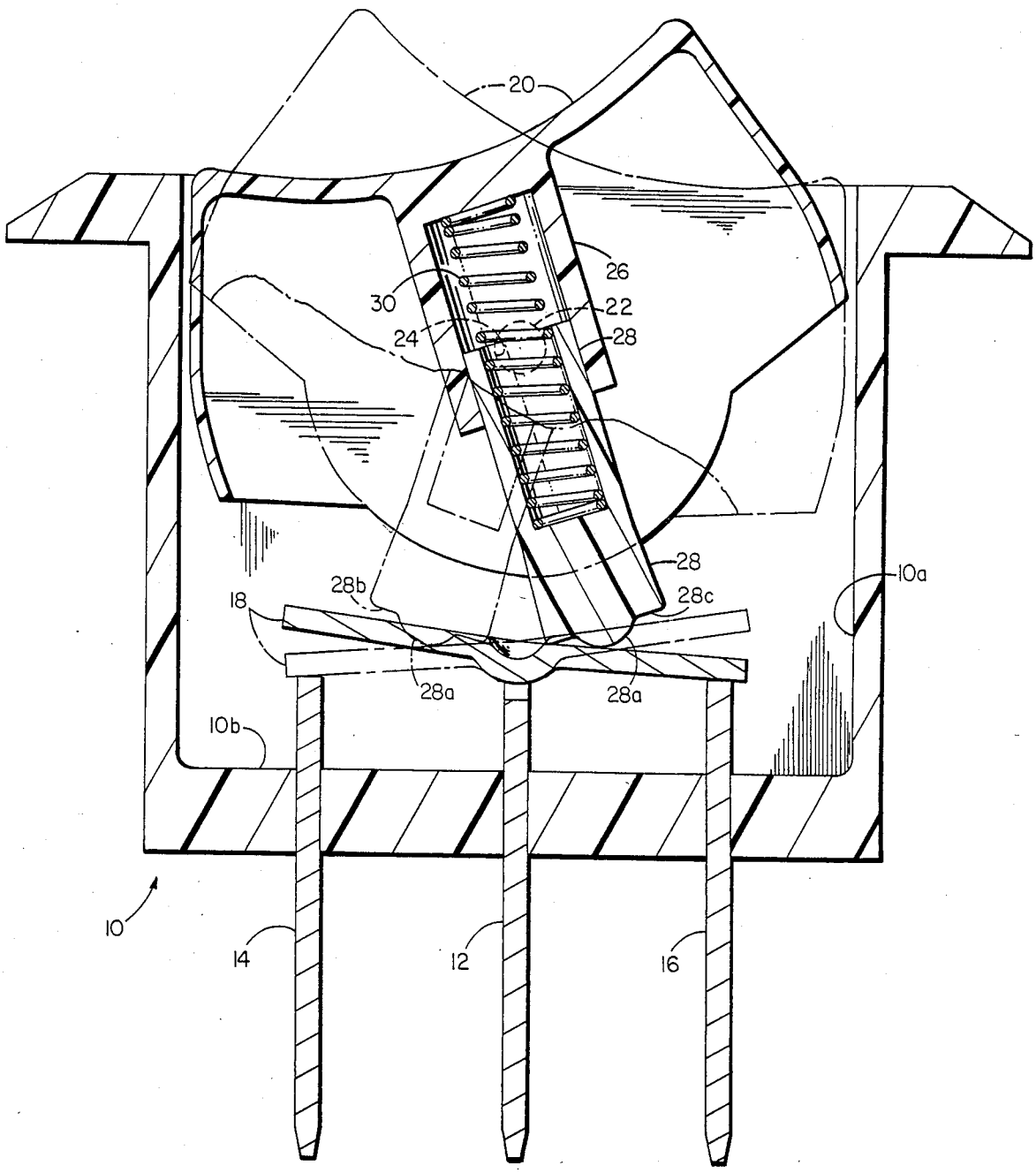
FIG. 2 is a sectional view similar to that of FIG. 1 but illustrating the actuator and movable contact in opposite on positions, one of which is shown in full lines and the other being illustrated in phantom lines.
Figure 3:
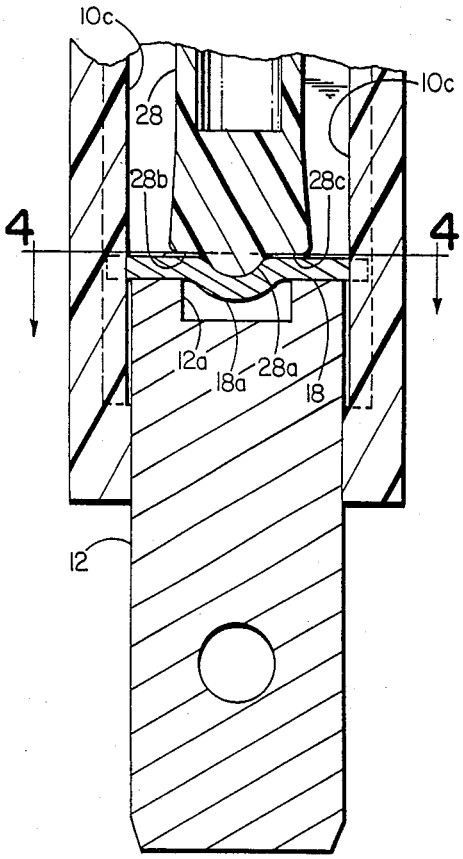
FIG. 3 is a sectional view taken generally on the line 3—3 of FIG. 1.

The center fixed contact 12 like the opposed fixed contacts 14 and 16 is formed from a flat strip and has an upper end portion defining a recessed area **12*a* such that a movable contact element 18 can be provided at the top or upper end of fixed contact 12 in such a manner that a depending portion 18*a* of movable contact 18 fits into recess 12*a* without interferring with the pivotal action of the contact element 18 as suggested in FIG. 2**.

Actuator means 20 is movably supported in the switch case 10, and more particularly between the side wall defining means of the case so as to permit movement of the actuator 20 in response to pressure applied to the exposed upper end portion of the actuator 20. The actuator includes support means 22 in the form of laterally projecting portions which fit into circular openings 24 provided for this purpose in the side walls of the switch case 10. These openings 24 comprise support regions of the side walls of the case to pivotably support the actuator 20 for movement between the limit positions illustrated in FIG. 2.

The actuator 20 defines a centrally located depending portion 26 which portion is adapted to slidably receive a plunger 28 and to provide a downwardly open recess for the spring 30 which acts between the actuator 20 and the plunger 28 to urge the latter downwardly into contact with the movable contact element 18. The plunger 28 has a lower end portion which is so shaped as to cooperate with an intermediate portion of the movable contact element 18 so as to support the movable contact on top of the fixed contact 12 and maintain this element 18 out of contact with the other of said fixed contacts 14 and 16 as suggested in FIG. 1. Movable contact element defines a centrally located detent 18*a* for receiving the center tip portion 28*a* of the plunger 28 for this purpose. Spaced abutment points 28*b* and 28*c* are also defined on the lower end portion of the plunger 28 and cooperate with the tip portion 28*a* to releasably retain the actuator and plunger in the center-off position shown in FIG. 1. Being spaced to either side of the top end portion of fixed contact 12 these spaced points can be seen to support the movable element 18 in the position there shown as a result of the downward biasing force exerted by the spring 30 on the plunger 28 and hence between the plunger 28 and the upper surface of the movable contact element 18. More particularly the spaced abutment points 28*b* and 28*c* are more particularly defined on the lower end portion of the plunger 28 by an annular flange 28*b/c* surrounding the tip portion 28*a* (compare FIG. 1 with that of FIG. 3).

Figure 4:
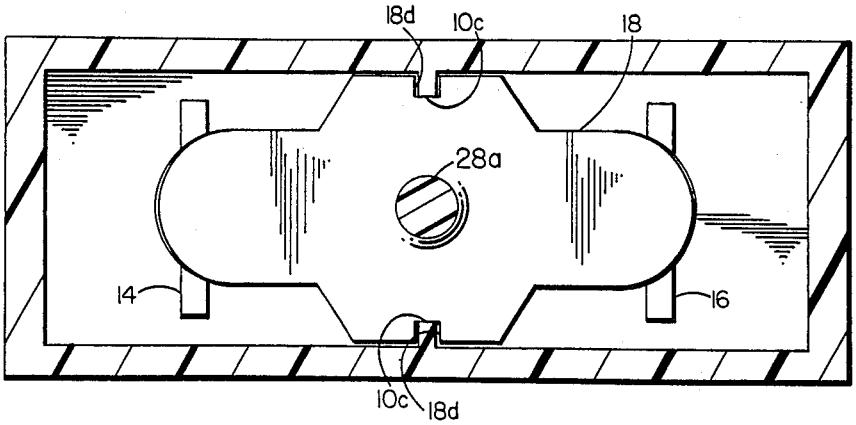
FIG. 4 is a horizontal sectional view taken generally on the line 4—4 of FIG. 3.

The means for restricting movable contact element 18 solely to pivotal movement and preventing any tendency for element 18 to translate laterally as a result of pivotal motion of the lower end of the plunger 28 will now be described with reference to FIG. 4. The switch case side walls have inwardly projecting oppositely arranged ribs 10*c*, 10*c* which ribs are adapted to be received in laterally open notches defined for this purpose in the longitudinally extending marginal edge portions of the movable contact 18. Thus, at assembly, the movable element 18 is dropped downwardly into the upwardly open switch case cavity with the notches 18*d*, 18*d* slidably received on these vertically extending ribs 10*c*, 10*c*.

Figure 5:
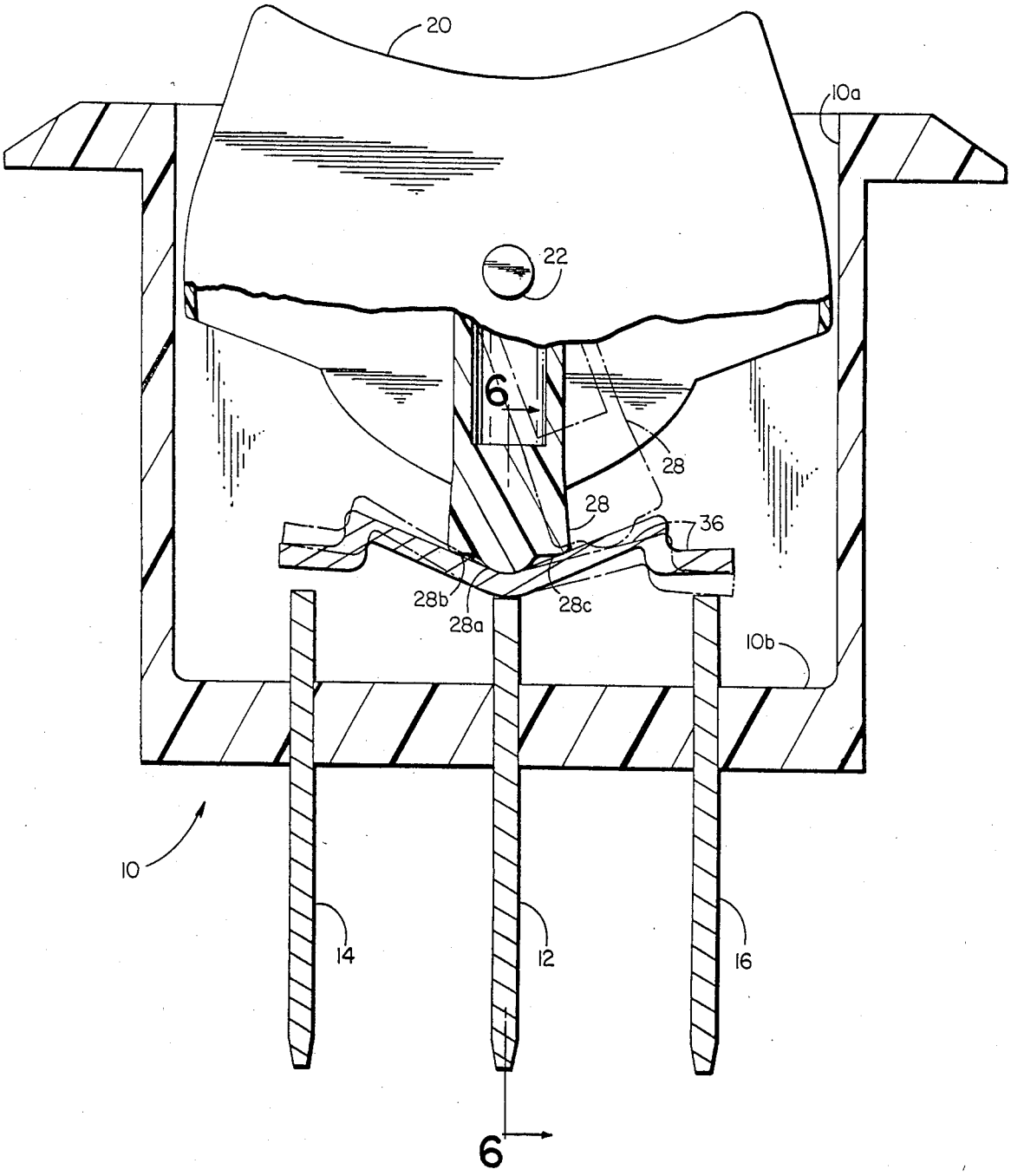
FIG. 5 is a vertical sectional view through a switch similar to that of FIGS. 1–4, but illustrating a different configuration for the movable contact element wherein the resulting switch configuration is capable of momentary on positions as suggested by the broken lines in FIG. 5.
Figure 6:
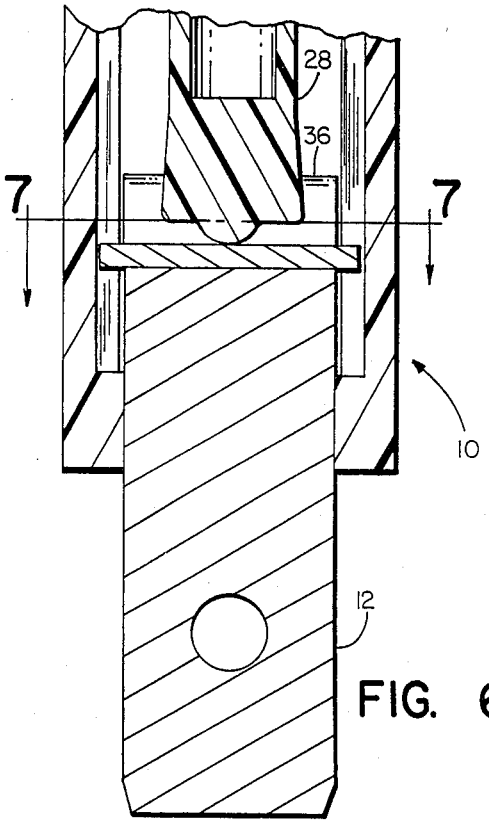
FIG. 6 is a sectional view taken generally on the line 6—6 of FIG. 5.
Figure 7:
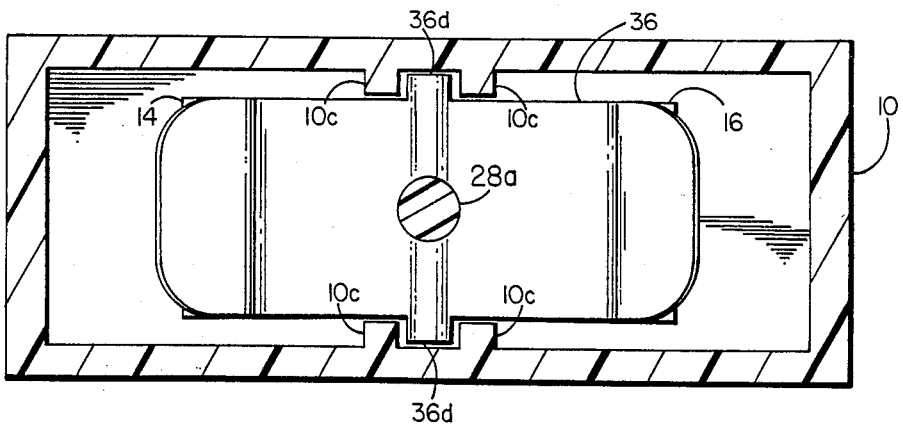
FIG. 7 is a horizontal sectional view taken generally on the line 7—7 of FIG. 6.

Turning next to a description of the FIGS. 5, 6 and 7, the switch case 10 shown in these views is similar to that illustrated with respect to FIGS. 1–4 inclusively, as is the configuration for the rocker 20 and its associated plunger 28. That is, fixed contacts 12, 14 and 16 are provided in slots in the bottom wall 10*b* of the switch case cavity, and the actuator 20 is pivotally supported by means of laterally spaced projections 22 received in aligned openings 24 of the switch case side walls so as to permit movement of the actuator 20 and of its associated plunger from the center off position shown to momentary on positions suggested in FIG. 5 by the broken lines for actuator 28 immediately to the right of the center-off position shown. Movable contact element 36 differs from the movable contact element 18 in some respects, but is similar to that described above with reference to 18 in that the center-off position is maintained by a lower tip portion 28*a* of plunger 28 cooperating with spaced abutment points 28*b* and 28*c* which cooperate with the recessed portion provided at the center of movable element 36 and with corresponding points spaced from this recessed center portion to achieve the stable off position shown. As the actuator 20 is rocked from the position shown to that suggested for the broken line position of plunger 28 it will be apparent that movable contact element 36 pivots in a clockwise fashion on the top of fixed contact 12 until the right hand end portion of movable contact element 36 engages the top of fixed contact 16. As a result of the geometry for the movable contact element 36 the force of the spring acting between the plunger 28 and the actuator 20 will serve to return plunger 28 from the broken line position to the solid line position of FIG. 5 once pressure on the actuator 20 is released. Thus, the switch of FIG. 5 defines a stable center-off switch with opposed momentary on positions (see broken line position shown). The features described herein above for the three position center-off switch of FIGS. 1–4 inclusively are also provided in the momentary switch.

Another difference between the switch of FIGS. 5–7 from that of FIGS. 1–4, and a feature which could be utilized in the switch of FIGS. 1–4, FIGS. 6 and 7 illustrate a slightly different configuration for the means for restraining the movable contact element 36 in the switch case 10 so that it moves only pivotably and cannot translate as a result of pivotal motion for the plunger 28 with which the element 36 interacts.

Movable contact element 36 can be seen from FIGS. 6 and 7 to be restricted to movement pivotably in the case 10 and as best shown in FIG. 7 spaced vertically extending ribs 10*c*, 10*c* are provided for receiving projecting tab portions 36*d* at the marginal edge portions of the element 36 for this purpose.

Figure 8:
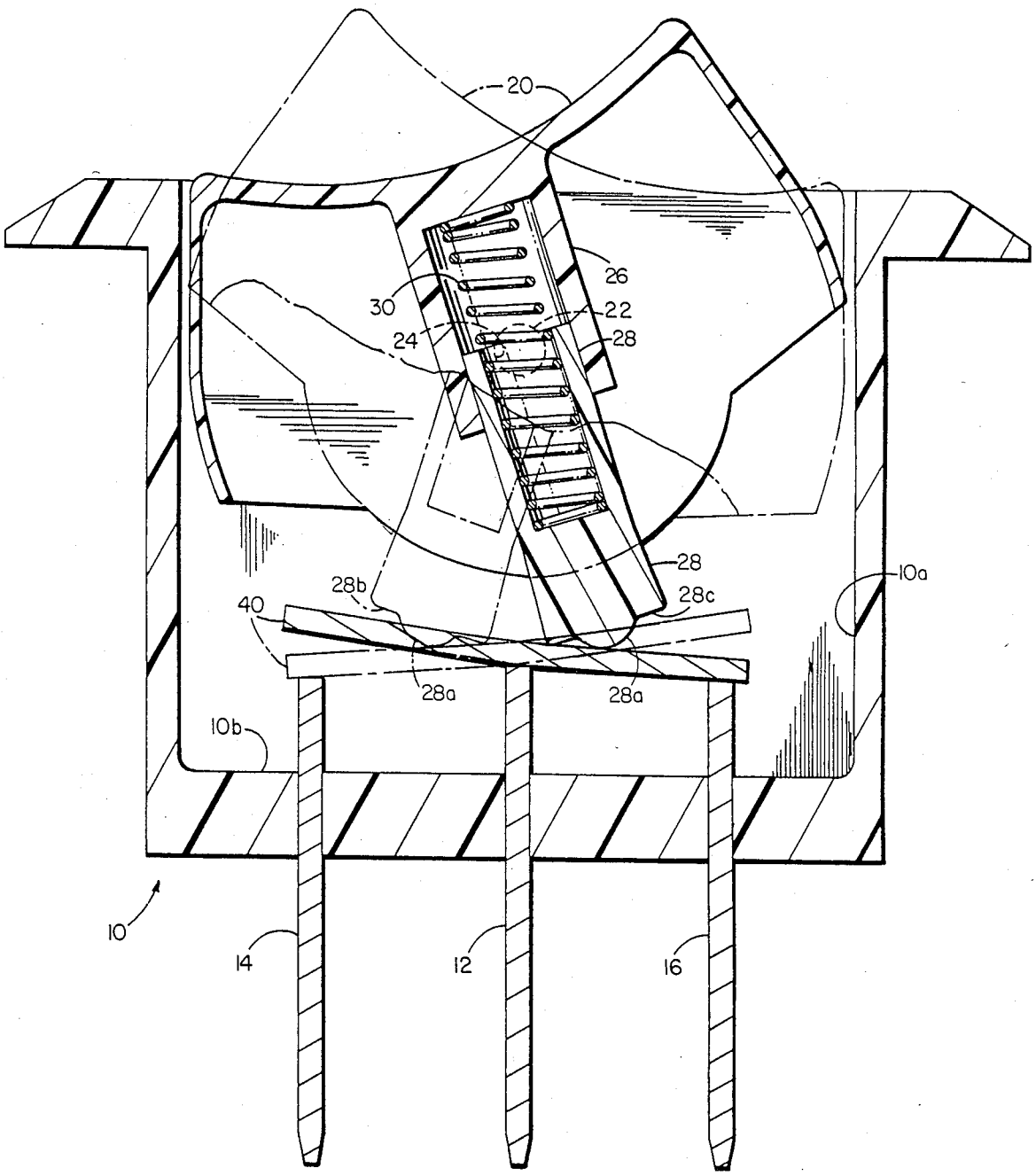
FIG. 8 illustrates a third embodiment of the present invention wherein a conventional two position movable contact element is adapted to be selectively positionable by a plunger mechanism and actuator constructed in accordance with the embodiments of FIGS. 1–6 inclusively.

With reference to the electrical switch shown in FIG. 8, a two position switch is there shown as having a pivotably mounted actuator 20 generally similar to that described above with reference to the previous embodiment. Instead of the center-off style movable contact element 18 and 36 respectively at two position contact element 40 cooperate with the lower end portion of the plunger 28 for achieving only two positions of said element 40. No detent or recess is provided in the upper surface of this element 40 thereby rendering the spaced contact points 28*b* and 28*c* of the plunger 28 unnecessary. However, it will be apparent from FIG. 8 that this plunger 28 can nevertheless be utilized in a two position switch, all that is required for the FIG. 8 switch being that the movable element 40 not have spaced lands which abut or engage the spaced abutment points 28*b* and 28*c* of the plunger when the actuator 20 is moved through its center position.

We claim:

1. An electric switch comprising a base having an upwardly open cavity of elongated rectangular configuration, cavity side walls defining actuator support regions, an actuator including support means cooperating with said support regions to movably support said actuator for limited movement longitudinally of said cavity, a plunger coupled to said actuator and movable in response to such actuator movement, plural fixed contacts provided in slots spaced longitudinally along the bottom wall of said cavity, a movable contact pivotably mounted on top of one such fixed contact, said one contact consisting only of a flat terminal strip, means restricting said movable contact from longitudinal sliding movement relative to said one fixed contact, said plunger having an end portion defining an annular flange engageable spaced portions of said movable contact to support said movable contact pivotably on the upper end of said one fixed contact and out of contact with other of said fixed contacts at least in a center position of said actuator said plunger end portion defining a tip portion surrounded by said annular flange, and said movable contact having a detent surrounded by said annular portion thereof, and biasing means to urge said plunger tip portion into engagement with said movable contact.

2. The switch of claim 1 wherein said detent defined by said movable contact comprises a recessed region of said intermediate portion of said movable contact, and wherein said means restricting said movable contact from longitudinally sliding movement comprises laterally spaced edge portions of said movable contact aligned laterally with said recessed region and cooperable with fixed structure in said cavity to permit only pivotal movement of said movable contact on said one fixed contact as aforesaid.

3. The switch of claim 2 wherein said laterally spaced edge portions define notches, and wherein said cooperable fixed structure comprises a vertically extending rib in each side wall of said base cavity, said ribs received in said notches to prevent longitudinal movement of said movable contact.

4. The switch of claim 2 wherein said laterally spaced edge portions define projecting tabs, and wherein said cooperable fixed structure comprises a vertically extending groove defined in each side wall of said base cavity, said tabs received in said grooves to prevent longitudinal movement of said movable contact.

5. The switch of claim 1 wherein said plunger is slidably received in a downwardly open recess provided for it in said actuator for limited movement toward and away from said movable contact to provide a lost motion connection between said actuator and said movable contact.

6. The switch of claim 5 wherein said biasing means for so urging said plunger toward said movable contact comprises a compression spring acting between said plunger and said actuator, said actuator pivotally supported in said switch base for movement between limit positions wherein the movable contact abuts other fixed contacts selectively, said movable contact being in continuous engagement with said one fixed contact.

* * * * *